US009038547B2

(12) United States Patent
Whiteford

(10) Patent No.: US 9,038,547 B2
(45) Date of Patent: May 26, 2015

(54) PALLET LEADER BOARD SYSTEM

(76) Inventor: Bede Whiteford, Moonbi (AU)

( * ) Notice: Subject to any disclaimer, the term of this patent is extended or adjusted under 35 U.S.C. 154(b) by 0 days.

(21) Appl. No.: 13/979,180

(22) PCT Filed: Jan. 19, 2012

(86) PCT No.: PCT/IB2012/050254

§ 371 (c)(1),
(2), (4) Date: Feb. 21, 2014

(87) PCT Pub. No.: WO2012/098514

PCT Pub. Date: Jul. 26, 2012

(65) Prior Publication Data

US 2014/0174327 A1 Jun. 26, 2014

(30) Foreign Application Priority Data

Jan. 20, 2011 (AU) ..... 2011900175

(51) Int. Cl.
*B65D 19/38* (2006.01)
*B65D 19/00* (2006.01)

(52) U.S. Cl.
CPC ..... *B65D 19/38* (2013.01); *Y10T 29/4998* (2015.01); *Y10T 29/49716* (2015.01); *Y10T 29/49826* (2015.01); *B65D 19/0095* (2013.01); *B65D 2203/12* (2013.01); *B65D 2519/00029* (2013.01); *B65D 2519/00034* (2013.01); *B65D 2519/00044* (2013.01); *B65D 2519/00064* (2013.01); *B65D 2519/00069* (2013.01); *B65D 2519/00079* (2013.01); *B65D 2519/00099* (2013.01); *B65D 2519/00104* (2013.01); *B65D 2519/00114* (2013.01); *B65D 2519/00273* (2013.01); *B65D 2519/00278* (2013.01); *B65D 2519/00293* (2013.01); *B65D 2519/00298* (2013.01); *B65D 2519/00323* (2013.01); *B65D 2519/00333* (2013.01); *B65D 2519/00572* (2013.01); *B65D 2519/0086* (2013.01); *B65D 19/0053* (2013.01); *B65D 2519/00736* (2013.01)

(58) Field of Classification Search
USPC ..... 108/57.25, 90, 902, 51.11, 56.1, 56.3
See application file for complete search history.

(56) References Cited

U.S. PATENT DOCUMENTS

| | | | | |
|---|---|---|---|---|
| 2,311,280 | A * | 2/1943 | Quayle | 108/57.1 |
| 3,118,400 | A * | 1/1964 | Kemp, Jr. et al. | 108/57.1 |
| 3,645,215 | A | 2/1972 | Kirkpatrick | |

(Continued)

FOREIGN PATENT DOCUMENTS

| | | |
|---|---|---|
| GB | 1016133 | 1/1966 |
| GB | 1122155 | 7/1968 |

*Primary Examiner* — Jose V Chen
(74) *Attorney, Agent, or Firm* — Whitham Curtis Christofferson & Cook, PC

(57) ABSTRACT

The present invention provides a leader board unit for use with a four-way entry pallet, the pallet being of a type which includes a plurality of parallel transverse top boards supported by a plurality of upper support planks, the leader board unit including: a top leader board parallel to and of substantially the same length as the transverse top boards; a bottom leader board parallel to, spaced apart from, and of substantially the same length as the top leader board; a plurality of support members formed integrally with and perpendicular to the top and bottom leader boards and holding the two leader boards in their spaced-apart configuration, each support member including a protrusion for mounting a respective upper support plank, the leader boards and support members being structurally integral and formed of a plastics material.

8 Claims, 6 Drawing Sheets

(56) References Cited

U.S. PATENT DOCUMENTS

| | | | | | |
|---|---|---|---|---|---|
| 3,910,203 | A | * | 10/1975 | Hamkins et al. | 108/51.11 |
| 4,220,099 | A | * | 9/1980 | Marchesano | 108/57.19 |
| 4,715,294 | A | * | 12/1987 | Depew | 108/57.17 |
| 5,320,048 | A | * | 6/1994 | Feiner | 108/51.11 |
| 5,333,555 | A | | 8/1994 | McPhee | |
| 5,579,701 | A | * | 12/1996 | Fook Wah | 108/56.1 |
| 5,896,818 | A | * | 4/1999 | Phillips | 108/51.11 |
| 6,216,608 | B1 | * | 4/2001 | Woods et al. | 108/57.25 |
| 6,708,629 | B2 | * | 3/2004 | Dumouchel | 108/57.25 |
| 6,802,267 | B1 | * | 10/2004 | Janus | 108/56.1 |
| 6,814,287 | B1 | * | 11/2004 | Chang et al. | 235/451 |
| 6,997,112 | B2 | * | 2/2006 | Nishizaki et al. | 108/51.3 |
| 7,216,592 | B2 | * | 5/2007 | Krech et al. | 108/185 |
| 7,487,730 | B2 | * | 2/2009 | Hedstrom | 108/56.3 |
| 7,578,244 | B2 | * | 8/2009 | Williams, Jr. | 108/56.3 |
| 7,874,256 | B2 | * | 1/2011 | Muirhead | 108/57.25 |
| 8,286,563 | B2 | * | 10/2012 | Low | 108/56.3 |
| 8,291,837 | B2 | * | 10/2012 | Kirkpatrick | 108/56.1 |
| 8,627,773 | B2 | * | 1/2014 | Storteboom et al. | 108/51.11 |
| 8,671,848 | B2 | * | 3/2014 | Randall et al. | 108/51.11 |
| 2005/0011418 | A1 | | 1/2005 | Nishizaki et al. | |
| 2009/0178595 | A1 | * | 7/2009 | Chen | 108/57.25 |
| 2010/0229764 | A1 | * | 9/2010 | Ingham | 108/51.3 |
| 2010/0288169 | A1 | * | 11/2010 | Du Toit | 108/57.25 |
| 2012/0132114 | A1 | * | 5/2012 | Krupka et al. | 108/57.25 |
| 2013/0061784 | A1 | * | 3/2013 | Kessler | 108/57.25 |

* cited by examiner

PALLET LEADER BOARD SYSTEM

CROSS-REFERENCE TO RELATED APPLICATIONS

This application is a national stage patent application under 35 USC 371 based on PCT/IB2012/050254 filed Jan. 19, 2012 which claims priority to Australian application 2011900175 filed Jan. 20, 2011.

FIELD OF THE INVENTION

The present invention relates to pallets for transporting and storing goods, and in particular the manufacturing, repairing, and/or strengthening of such pallets.

BACKGROUND OF THE INVENTION

Pallets are commonly used to transport and/or store goods.

Typical wooden pallets include a top deck on which goods are stacked. The top deck is formed by a plurality of parallel transverse top boards mounted on a frame. When the pallet 100 is to be lifted the forks of a forklift are located in passages in the frame.

When locating the forks of the forklift in the pallet passages it is common for the forklift to drive towards the pallet until the forklift collides with the pallet. This collision is between the forklift and the top and bottom leader boards of the pallet (at the front or rear of the pallet), and after repeated such collisions causes damage to those boards. The damage to the leader boards includes splintering and cracking, dislodgement from the bearer blocks of the frame, deformation of the boards, and/or deformation of the pallet as a whole (e.g. by skewing of the pallet). This damage, in combination with the general forces imparted with the repeated impact of the fork-lift, to the front and rear leader boards substantially affects the structural integrity of the pallet as a whole to the extent that frequent and regular repairs of the pallet are required.

Damaged boards also often cause damage to the goods stored on the pallet due to protruding splinters and/or nails scratching, piercing and/or embedding themselves in those goods.

Further, damaged boards or deformed pallets can in turn cause damage or disruption to conveyor belts and other transport means due to becoming stuck on the conveyor/in the transport. In some automated warehouse systems, pallets are scanned and if a pallet does not conform with the dimensions etc required (e.g. by pallet or board deformation) processing of the pallets is shut down causing expensive delays.

In order to deal with the problem of damaged pallets there are numerous pallet repair facilities located around the world. A damaged pallet is generally repaired by removing any damaged boards and replacing them with new boards. This is a relatively time consuming and expensive process (both in terms of the repair and the "downtime" of the pallet) and one that doesn't so much fix the problem as merely delay the problem: a band aid approach. Further, if repairs are not correctly carried out the repaired pallet may not be of the correct dimensions/specifications and cause problems when being processed (as discussed above).

While pallets of alternative constructions to the traditional wooden pallet have been considered (e.g. plastics or metal pallets) such alternative pallets are inevitably too expensive for the benefits added, leaving wooden pallets and along with their high frequency repair cycle the most common form of pallet.

Additionally, where pallets are made of plastics materials the pallets slip (rather than grab) on the chain conveyers typically provided in automated warehouse systems. This is due to insufficient friction provided by the plastic pallet.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide a pallet or pallet leader board that overcomes or at least ameliorates some of the abovementioned disadvantages or which at least provides the public with a useful choice.

Other objects of the invention may become apparent from the following description which is given by way of example only.

SUMMARY OF THE INVENTION

In one aspect, the present invention provides a leader board unit for use with a four-way entry pallet, the pallet being of a type which includes a plurality of parallel transverse top boards supported by a plurality of upper support planks, the leader board unit including:

a top leader board parallel to and of substantially the same length as the transverse top boards;

a bottom leader board parallel to, spaced apart from, and of substantially the same length as the top leader board;

a plurality of support members formed integrally with and perpendicular to the top and bottom leader boards and holding the two leader boards in their spaced-apart configuration, each support member including a protrusion for mounting a respective upper support plank, the leader boards and support members being structurally integral and formed of a plastics material.

In a further aspect the invention relates to four-way entry pallet suitable to be handled by the forks of a fork-lift, the pallet being primarily of wood construction, protected at the fork engaging ends of the pallet by fitment, capping, overmoulding or lamination by plastic designed to resist at least some for entry damage.

In a further aspect the invention relates to a wooden a four-way entry pallet, of a type which includes a plurality of parallel transverse top boards supported by a plurality of upper support planks, salvaged from a damaged wooden pallet where one or more ends of the salvaged pallet are replaced with an integrally plastic moulded leader board unit that is formed of a plastics material, the plastic moulded leader board having 1. a top leader board parallel to and of substantially the same length as the transverse top boards of a pallet,
2. a bottom leader board parallel to, spaced apart from, and of substantially the same length as the top leader board, and
3. a plurality of support members formed integrally with and perpendicular to the top and bottom leader boards and holding the two leader boards in their spaced-apart configuration, each support member including a protrusion for affixing to the wooden pallet support planks.

In a further aspect the invention relates to a method of forming a four-way entry pallet, the pallet being of a type that includes a plurality of parallel transverse top boards supported by a plurality of upper support planks comprising the steps of 1. providing at least one integrally plastic moulded leader board unit that is formed of a plastics material, the plastic moulded leader board having
   a) a top leader board parallel to and of substantially the same length as the transverse top boards,
   b) a bottom leader board parallel to, spaced apart from, and of substantially the same length as the top leader board, and
   c) a plurality of support members formed integrally with and perpendicular to the top and bottom leader boards and holding the two leader boards in their spaced-apart configuration, each support member including a protrusion;
2. providing a plurality of wooden upper support planks having a first and second end;
3. if one integrally plastic moulded leader board used, providing at least one bearer block;
4. attaching at least one pair of wooden upper supports at their first end to an integrally plastic moulded leader board protrusions, and
   a) if one integrally plastic moulded leader board used, attaching a bearer block between said pair or pairs of wooden upper supports, or
   b) if two integrally plastic moulded leader boards are used, attaching the second end of said wooden upper supports to the corresponding protrusions of the second plastic moulded leader board.

In a further aspect the invention relates to a method of converting a wooden four-way entry pallet into a four-way entry pallet reliant on salvageable boards of the wooden pallet, the method comprising or including interposing and fixing a moulded plastics leader board unit between each of the upper and lower sets of wooden supports at one or both of the opposed ends, such plastic leader board or boards allowing fork entry transverse to the plastic leader board axis and without preventing fork entry longitudinally of the plastic leader board axis.

In a further aspect the invention relates to a kit for forming a four-way entry pallet, the pallet being of a type that includes a plurality of parallel transverse top boards supported by a plurality of upper support planks, said kit comprising at least one integrally plastic moulded leader board unit that is formed of a plastics material, the plastic moulded leader board having
   a) a top leader board parallel to and of substantially the same length as the transverse top boards,
   b) a bottom leader board parallel to, spaced apart from, and of substantially the same length as the top leader board, and
   c) a plurality of support members formed integrally with and perpendicular to the top and bottom leader boards and holding the two leader boards in their spaced-apart configuration, each support member including a protrusion;

one or more upper support planks; and optionally one or more bearer blocks.

In a further aspect the invention relates to a plastic overmoulded plastic leader board unit as described in the statements above for use in a wooden pallet.

The following embodiments may relate to any of the above aspects.

In some embodiments the four-way pallet comprises a pair of plastic moulded leader board units at opposing ends of the pallet.

In some embodiments the plastic moulded leader board unit is formed by overmoulding plastic over a core material. In some embodiments the core material is wood or processed wood.

In some embodiments the plastic moulded leader board comprises holes to reduce the amount of plastic used.

In some embodiments each protrusion of each plastic moulded leader board carries a pair of upper support planks, the protrusion being sandwiched between the pair of upper support planks.

In some embodiments, where two plastic moulded leader board units are used, at opposing ends of the pallet, the pallet also includes the use of at least one bearer blocks sandwiched between a pair of upper support planks.

In some embodiments the leader board unit includes an identification device. In some embodiments the identification device may be a RFID device.

In some embodiments the plastic may be selected from the group of HDPE, glass reinforced polypropylene, and polyoxymethylene.

In some embodiments the leader board unit is formed in an injection moulding process. In some embodiments the injection moulding process may be a water injection moulding process. In some embodiments nitrogen may be used as a foaming agent in the injection moulding process.

In some embodiments the identification device may be moulded into the leader board unit.

In a further aspect the present invention provides a pallet including one or more leader board units as described in the above statements.

In a further aspect the present invention provides the use of a pallet including one or more leader board units as described in the above statements.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Other aspects of the invention may become apparent from the following description which is given by way of example only and with reference to the accompanying drawings.

BRIEF DESCRIPTION OF THE DRAWINGS

Embodiments of the present invention will now be described with reference to the accompanying drawings in which.

DETAILED DESCRIPTION OF THE EMBODIMENTS

1. Definitions

Figure 1:
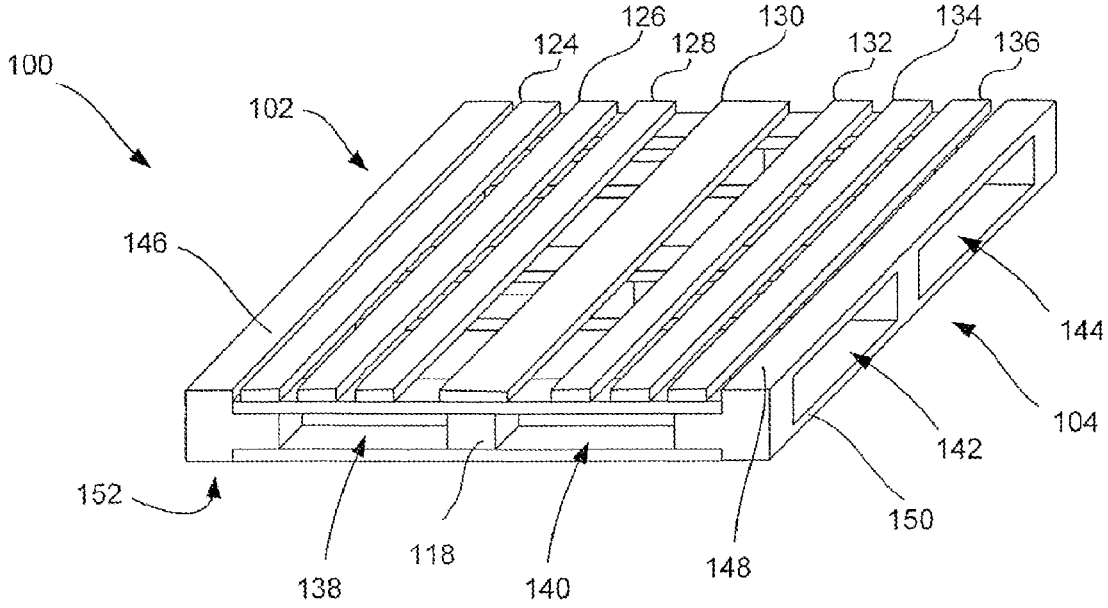
FIG. 1 provides a perspective view of a pallet fitted with leader board units in accordance with an embodiment of the invention.

The term "comprising" as used in this specification means "consisting at least in part of". When interpreting statements in this specification which include that term, the features, prefaced by that term in each statement, all need to be present but other features can also be present. Related terms such as "comprise" and "comprised" are to be interpreted in the same manner.

The phrase "leader board" in this specification is intended to refer to those boards of a pallet which are subject to direct impact when a forklift engages with the pallet. For example, pallet 100 in FIG. 1 has four leader boards: top leader boards 146 and 148 and bottom leader boards 150 and 152.

Similarly, the terms "front", "rear", "bottom" and "top" in respect of pallets and leader board units shown in the drawings are, of course, relative, and throughout this specification are used in reference to the particular orientation of the pallet as shown in the representations.

2. Leader Board Unit

In one aspect, the invention relates to a leader board unit for use with a four-way entry pallet, the pallet being of a type which includes a plurality of parallel transverse top boards supported by a plurality of upper support planks, the leader board unit including:

a top leader board parallel to and of substantially the same length as the transverse top boards;

a bottom leader board parallel to, spaced apart from, and of substantially the same length as the top leader board;

a plurality of support members formed integrally with and perpendicular to the top and bottom leader boards and holding the two leader boards in their spaced-apart configuration, each support member including a protrusion for mounting a respective upper support plank, the leader boards and support members being structurally integral and formed of a plastics material.

While the leader boards are not the only boards to be damaged during the use of a pallet they are (as described in the background above) typically the boards that are most often damaged given they are the boards which a forklift collides with when picking up the pallet.

Figure 2:
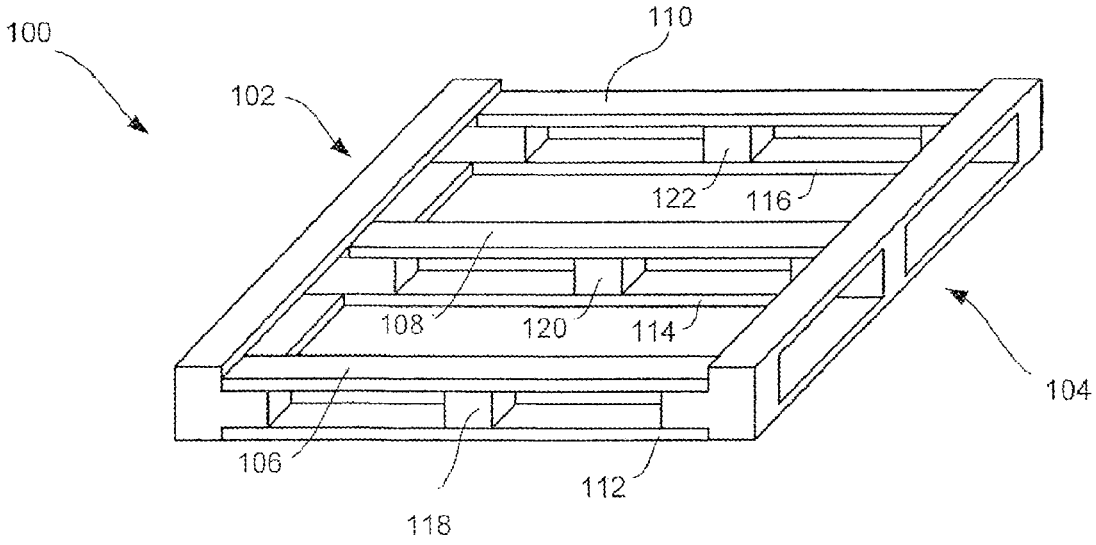
FIG. 2 provides a perspective view of the pallet of FIG. 1 with the transverse top boards removed.

FIGS. 1 and 2 provide perspective views of a four-way entry pallet 100. As can be seen, a forklift may approach and engage with pallet 100 from either the front, rear, left or right. Pallet 100 has been fitted with two leader board units 102 and 104 in accordance with an embodiment of the present invention.

The left and right ends of pallet 100 (as oriented in the illustrated embodiment) are fitted with leader board units 102 and 104. Extending between the leader board units 102 and 104 are a plurality of upper support planks 106, 108, and 110, and lower support planks 112, 114 and 116 (most easily seen in FIG. 2 which provides a depiction of pallet 100 without the transverse top boards). Secured between corresponding upper and lower support planks (106/112, 108/114, 110/116) and approximately halfway along their length are bearer blocks 118, 120 and 122.

The transverse top boards 124 to 136 of pallet 100 are secured to the upper support planks 106, 108, and 110 by nails or other suitable fasteners.

As will be appreciated, the configuration of pallet 100 is such that a forklift may approach and lift the pallet either from the front or back (in which case the forks will locate in passages 138 and 140) or the left or right (in which case the forks will locate in passages 142 and 144).

Figure 3:
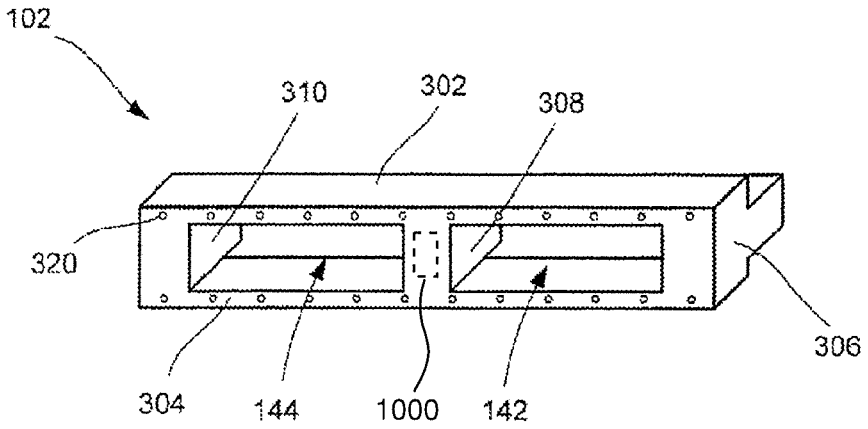
FIG. 3 provides a front perspective view of a leader board fitted to the pallet of FIG. 1.
Figure 4:
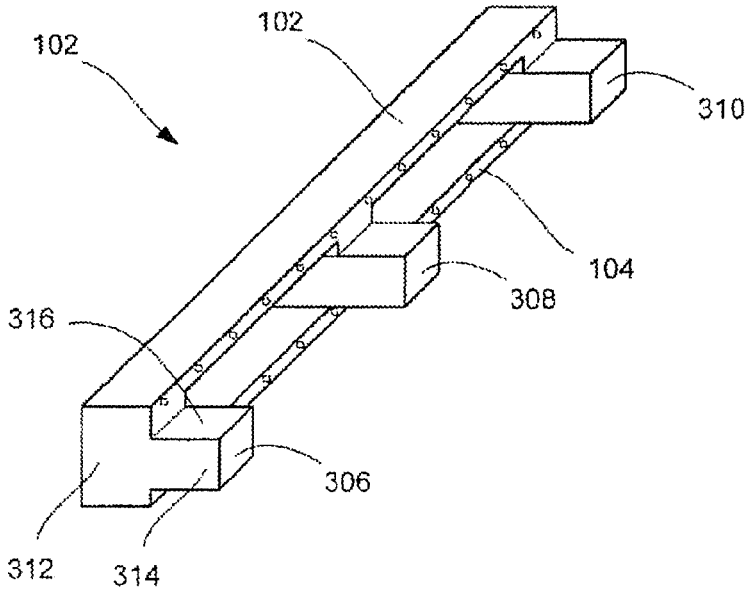
FIG. 4 provides a side perspective view of the leader board unit of FIG. 3.

Turning to FIGS. 3 and 4, the leader board unit 102 (which is identical to leader board unit 104) includes:

a top leader board 302;

a bottom leader board 304; and three support members perpendicular to the top and bottom leader boards 302 and 304 and extending there between:

a right support member 306;

an internal support member 308; and a left support member 310.

Support members 306 and 310 are located at either end of the leader board unit 102 with support member 308 roughly centred between them. As will be appreciated, the right and internal support members 306 and 308 define one of the fork passages (e.g. 144) and the internal and left support members 308 and 310 define a second fork passage (e.g. 142).

While the support members 306 to 310 have for ease of description been referred to as extending between the top and bottom leader boards 302 and 304, the leader board unit is manufactured as an integral unit and as such the tops and bottoms of the support members 306 to 310 are actually part of the top and bottom leader boards 302 and 304 (or vice versa).

The height of the support members 306 to 310 is selected to provide the desired distance between the top leader board 302 and the bottom leader board 304 and, consequently, the height of the fork receiving passages 138, 140, 142 and 144 in a pallet 100 to which the leader board units are fitted.

As can most easily be seen in FIG. 4, which provides a side perspective view of the leader board unit 102, the support members 306, 308 and 310 each have a solid body portion 312 between the top and bottom leader boards 302 and 304, and a protrusion 314 extending away from the top and bottom leader boards 302 and 304. Each protrusion 314 is offset from both the top and bottom leader boards 302 and 304, providing the leader board unit 102 with a roughly "T"-shaped profile.

The upper side 316 of protrusions 314 are offset from the top of the leader board unit 102 by the height of the upper support planks (106 to 110) plus the height of the transverse top planks (124 to 136). This offset allows the top planks 124 to 136 to be level with the top of the leader board units 102 and 104 when the leader board units 102 and 104 and pallet 100 are assembled (as discussed in more detail below).

The lower side 318 of protrusions 314 are offset from the bottom of the leader board unit 102 by the height of the lower support planks 112 to 116. This offset allows the lower support planks 112 to 116 to be level with the bottom of the leader board units 102 and 104 when the leader board units 102 and 104 and pallet 100 are assembled (as discussed in more detail below).

3. Manufacture

During manufacture, each leader board unit 102 and 104 may be moulded with a series of cored out holes 320, for example along the length of the top and bottom leader boards 302 and 304. By providing such a series of holes 320 the amount of plastic required in the leader board units (and therefore the cost and weight of the leader board units) is reduced, and the plastic cures more rapidly.

In some embodiments one or more of the pallet components is formed by overmoulding. For example, bearer blocks 118, 120 or 122 may be formed by overmoulding, as well as the leader board units 102 or 104. For example, when the leader board units (602, 604) are formed by overmoulding in some embodiments the entire leader board unit (602, 604) is formed by overmoulding. In some embodiments part only of the leader board unit (602, 604) is formed by over moulding. For example, in some embodiments one or more of the protrusions (606, 608, 610, 612, 614 or 616) are formed as overmoulded blocks whether integral or separate to the remainder of the leader board unit.

As one example of the manufacture of the leader board unit by overmoulding, the leader board unit (i.e. 602) is moulded in a single mould. Over moulding is achieved by including in the mould the material that the plastic is to be moulded around. For example, the plastic may be overmoulded about wood. It should be appreciated that any wood product could be used such as composite wood or unprocessed wood.

An advantage of overmoulding plastic over a material such as wood is that, as plastic does not have a good memory, the inner core of wood or composite wood assists retention of fasteners, such as nails or screws, used to assemble the pallet. Additionally, the overmoulding components will also reduce the splitting of blocks when a pallet is impacted by the forks of a fork lift.

In some embodiments the overmoulded blocks are formed by overmoulding plastic over composite wood. In some embodiments the plastic used to overmould the inner core of wood is an impact modified plastic.

Figure 5:
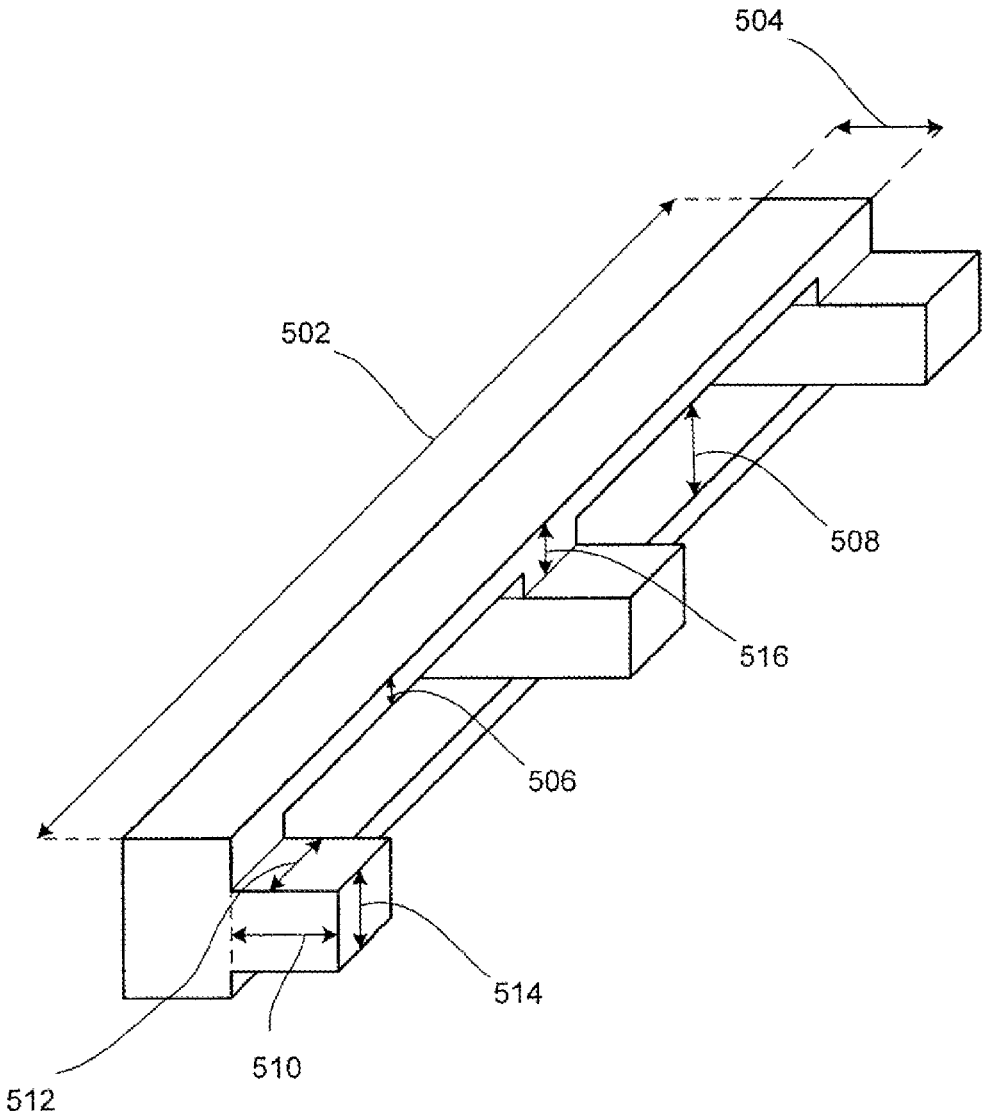
FIG. 5 provides a side perspective view of the leader board unit of FIG. 3 showing various dimensions.

Referring to FIG. 5, and by way of example only, the approximate dimensions of the leader board unit may be as follows:

Top and bottom leader board length 502: 1,119 mm
Top and bottom leader board width 504: 150 mm
Top and bottom leader board depth 506: 25 mm (Equal to offset of lower side of protrusion)
Distance between top and bottom leader board 508: 100 mm
Length of protrusion 510: 150 mm
Width of protrusion 512: approx 100 mm to 150 mm
Height of protrusion 514: 100 mm
Offset of upper side of protrusion 516: 50 mm It will, of course, be appreciated that different dimensioned leader board units may be provided as is appropriate for the particular pallet to which the leader board unit is to be fitted.

One way of assembling a pallet 100 with two leader board units 102 and 104 will now be described with reference to FIGS. 6A to 6D.

Figure 6A:
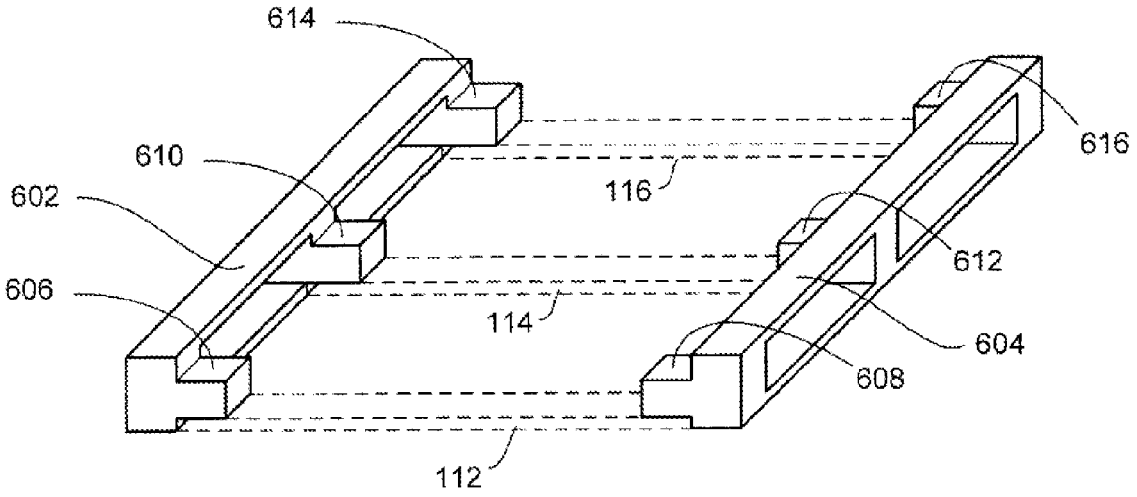
FIGS. 6A to 6D provide perspective views of the various assembly stages of a pallet as depicted in FIG. 1.

Firstly, and referring to FIG. 6A, the lower support planks 112, 114 and 116 are secured between the two leader board units 602 and 604. This involves:

securing one end of the lower support plank 112 to the lower side of protrusion 606 of leader board unit 602 and the opposite end to the lower side of protrusion 608 of leader board unit 604;

securing one end of the lower support plank 114 to the lower side of protrusion 610 of leader board unit 602 and the opposite end to the lower side of protrusion 612 of leader board unit 604; and securing one end of the lower support plank 116 to the lower side of protrusion 614 of leader board unit 602 and the opposite end to the lower side of protrusion 616 of leader board unit 604.

Figure 6B:
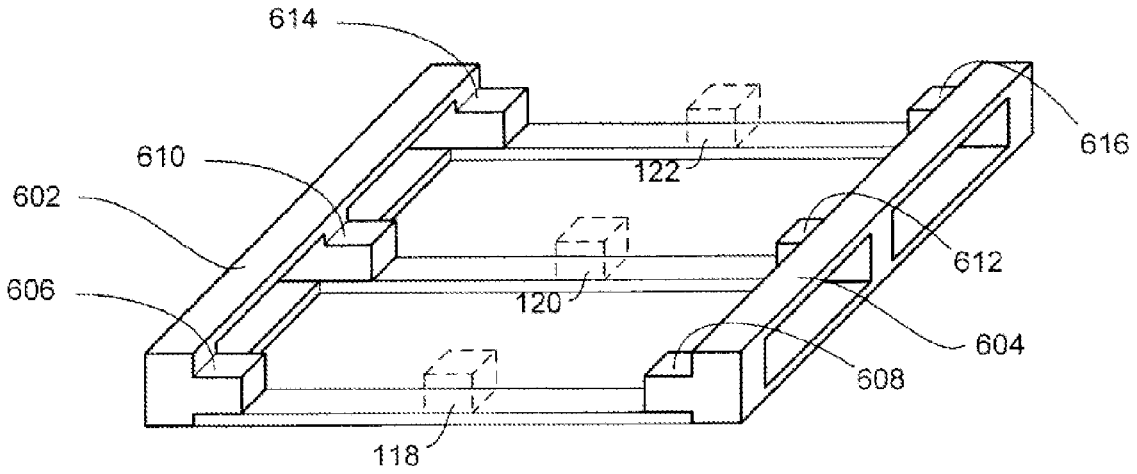

Turning to FIG. 6B, once the lower support planks 112 to 116 have been secured to the leader board units 102 and 104 the bearer blocks 118, 120 and 122 are secured in place to their respective lower support planks 112, 114 and 116.

Figure 6C:
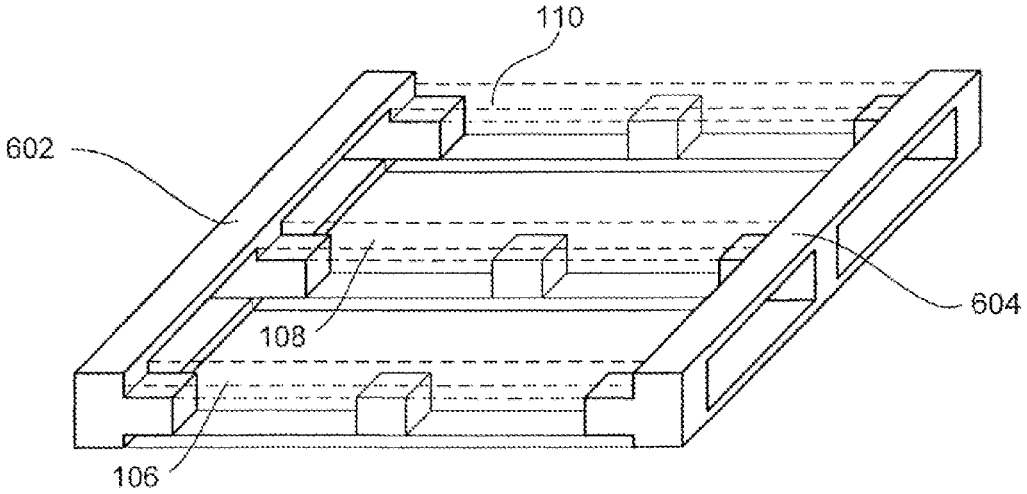

As shown in FIG. 6C, the upper support planks 106, 108 and 110 are then secured between the two leader board units 102 and 104. This involves:

securing one end of the upper support plank 106 to the upper side of protrusion 606 of leader board unit 602 and the opposite end to the upper side of protrusion 608 of leader board unit 604;

securing one end of the upper support plank 108 to the upper side of protrusion 610 of leader board unit 602 and the opposite end to the upper side of protrusion 612 of leader board unit 604; and securing one end of the upper support plank 110 to the upper side of protrusion 614 of leader board unit 602 and the opposite end to the upper side of protrusion 616 of leader board unit 604.

In addition to securing the upper support planks 106 to 110 to the respective leader board unit protrusions, the upper support planks 106 to 110 are also secured to their respective bearer blocks 118 to 122.

Figure 6D:
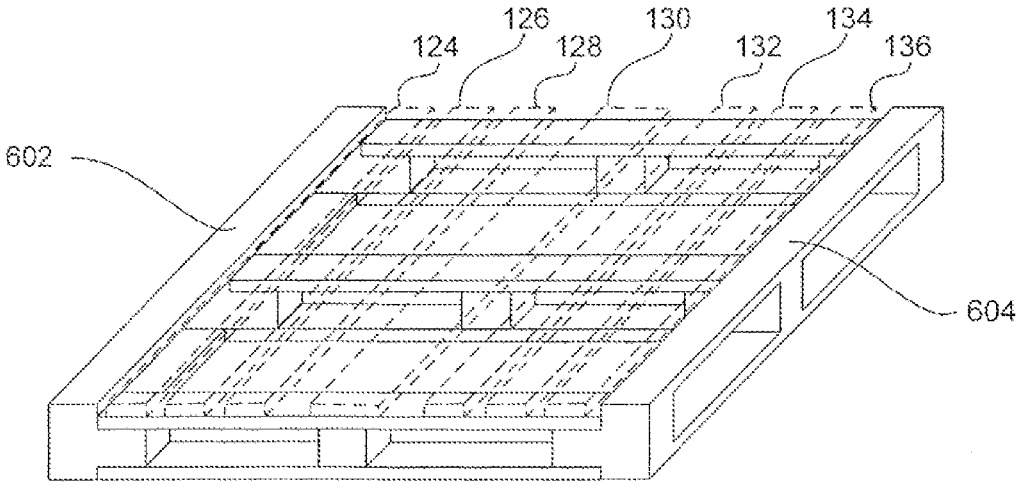

Finally, as depicted in FIG. 6D, the transverse top boards 124 to 136 are laid across and secured to the upper support planks 106 to 110.

The various boards and planks may be secured by nails, bolts, or any other suitable fasteners. As will be appreciated, if fasteners of sufficient length are used to secure the transverse top boards lying above the support members 306 to 310 and the bearer blocks 118 to 122, the fasteners will pass through the transverse top boards and the upper support planks 106 to 110 and into the support members 306 to 310 or bearer blocks 118 to 122. If desired this may serve to secure the upper support planks 106 to 110 to the respective support members and bearer blocks 118 to 122 without requiring additional fasteners.

The leader board units 102 and 104 are formed as an integral plastic unit in an injection moulding process. Plastics suitable for use include, for example, HDPE, glass reinforced polypropylene, and polyoxymethylene (such as DuPont's "Delrin") Any colour plastic may be used, which in turn may allow for visual identification of pallets via the colour of the attached leader board unit. Different colours could be used, for example, to indicate strength of a pallet, the goods being carries on a pallet, or the owner of the goods being carried on a pallet.

Ideally the injection moulding process employs known techniques and methods for imparting strength to the plastic. Such techniques include the use of nitrogen gas as a foaming agent or using a water injection moulding process.

Figure 7:
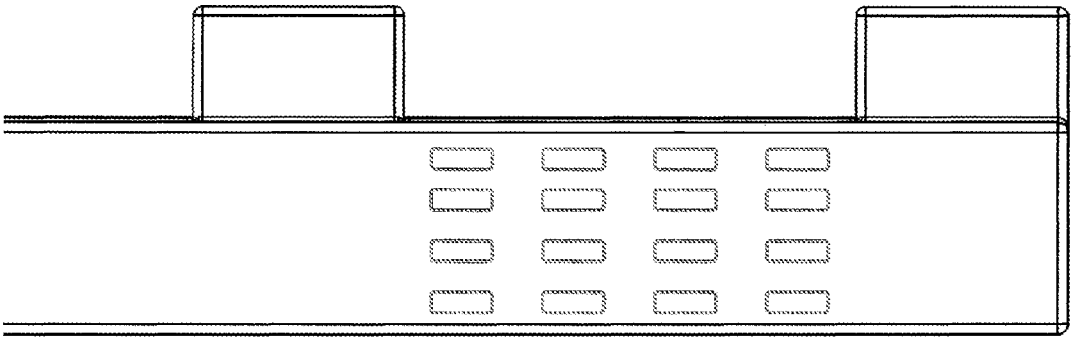
FIG. 7 is a plan view of a leader board unit showing the provision of holes in the top board 146, 148.

With reference to FIGS. 1 and 7, in some embodiments the top (146, 148) and/or bottom (152) boards of the leader board unit include holes. An advantage of the holes are that they provides for faster curing of the plastic as well as reducing the amount, and therefore the cost, of plastic used: while still retaining the required strength characteristics.

In some embodiments each of the top and/or bottom boards comprise approximately 64 holes of approximately 16×31.75 mm×22.5 mm as shown in FIG. 7.

4. Identification Device

During manufacture an identification device may be moulded into one (or both if desired) of the leader board units 102 and 104 to allow identification of a pallet to which the leader board units 102 and 104 are secured. The identification device may, for example, be a number, a barcode, a radio frequency identification (RFID) device, or rewriteable tracking chip.

Where the identification device 1000 is fragile (such as a RFID device or tracking chip) the device may be provided in a protective casing and the entire protective casing moulded into the leader board units 102 and 104. Alternatively, the identification device 1000 may be moulded into the leader board unit 102 and 104 at a location that is not prone to being damaged. As will be appreciated, the moulding of an identification device into a plastic leader board unit 102 and 104 is a relatively simple operation in contrast with attempting to embed such a device in a traditional wooden pallet.

Identification of a pallet may be used to associate a pallet with various data of interest using, for example, a database. If desired the use of identification devices leader board units 102 and 104 may also be used to provide historical data on a pallet (i.e. from first time a pallet was provided with an identification device, through repairs and up to decommissioning of pallet). Alternatively, the database could be maintained to associate identifications relating to the same pallet (such as ID 1000 [decommissioned]=ID 1200 [decommissioned]=ID 1300 [Active]).

Data of interest regarding a pallet may include:

the location of the pallet (i.e. the identification device may be read at various points to maintain up to date information on the location of the pallet);

the carrier of the pallet (i.e. transport company);

the goods loaded onto the pallet;

the usage history of the pallet;

a damage history of the pallet (i.e. what damage occurred, how, and by what company);

a repair history of the pallet; and/or the time since last repair of the pallet.

The identification device may also be configured to match data with forklift sensors to determine which fork lift driver damages pallets. For example, there are known forklift monitoring systems which sense jolts to the forklift and driver identification data against those jolts. The identification device in the leader board unit 200 or 102 could be matched to this data to determine the amount of damage being done by drivers.

Due to the integral construction of the leader board units 102 and 104 from relatively rigid plastic, when the leader board units 102 and 104 are fitted to a pallet it forms a composite frame with the pallet which serves to strengthen and stabilise the pallet. Where leader board units 102 and 104 are used in the manufacture of new pallets, the additional structural integrity given to a pallet by the leader board units 102 and 104 can allow for pine boards (or similar) to be used for the remaining transverse boards instead of the traditionally used (and more expensive) hardwood boards.

As will be appreciated, stabilising the pallet aids in keeping the pallets shape which, in turn, reduces the number of deformed pallets and conveyer stoppages due to pallets falling outside of required dimensions.

Additionally, the plastic material from which the leader board units 102 and 104 are made is less prone to splintering, buckling and deforming when impacted by a forklift than its wooden counterparts are. The reduced likelihood of splintering is advantageous in that it leads to a reduced possibility of the goods being carried on the pallet being contaminated by wood chips and other debris splintered off the pallet.

By providing a composite pallet (i.e. a wooden pallet with plastic leader board units 102 and 104 at either end) the advantages obtained by use of the leader board units 102 and 104 (i.e. increased pallet strength and reduced likelihood of splintering/buckling etc) are combined with the advantages of traditional wooden pallets (such as the environmental desirability of using wood over plastic).

Also, as the composite pallet is constructed of both wood and plastic the problem of slippage on conveyers experienced by pallets constructed entirely of plastic are avoided (the wooden parts of the pallet providing sufficient friction to engage with the conveyor).

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

The invention claimed is:

1. A method of forming a four-way entry pallet, the pallet being of a type that includes a plurality of parallel transverse top boards supported by a plurality of support planks comprising the steps of i) providing at least one integrally plastic moulded leader board that is formed of a plastics material, the plastic moulded leader board having a) a top leader board parallel to and of substantially the same length as the transverse top boards, b) a bottom leader board parallel to, spaced apart from, and of substantially the same length as the top leader board, and c) a plurality of support members formed integrally with and perpendicular to the top and bottom leader boards and holding the two leader boards in their spaced-apart configuration, each support member including a protrusion;

ii) providing a plurality of wooden upper support planks having a first and second end, iii) if one integrally plastic moulded leader board used, providing at least one bearer block, iv) attaching at least one pair of wooden supports at their first end to one of said protrusions of said plurality of support members of said integrally plastic moulded leader board, and a) if one integrally plastic moulded leader board used, attaching a bearer block between said at least one pair of wooden supports, or b) if two integrally plastic moulded leader boards are used, attaching the second end of said wooden supports to a corresponding protrusion of a second plastic moulded leader board.

2. A method according to claim 1, wherein the leader board unit is formed in an injection moulding process and the identification device moulded into the leader board unit.

3. A method of claim 2, wherein the plastic is selected from the group of high density polyethylene (HDPE), glass reinforced polypropylene, and polyoxymethylene.

4. A method of claim 1, wherein the plastic is selected from the group of high density polyethylene (HDPE), glass reinforced polypropylene, and polyoxymethylene.

5. A method of claim 1, wherein the leader board unit is formed in an injection moulding process.

6. A method of claim 5, wherein nitrogen is used as a foaming agent in the injection moulding process.

7. A method of claim 5, wherein the injection moulding process is a water injection moulding process.

8. A kit for forming a four-way entry pallet, the pallet being of a type that includes a plurality of parallel transverse top boards supported by a plurality of upper support planks, said kit comprising at least one integrally plastic moulded leader board that is formed of a plastics material, the plastic moulded leader board having a top leader board parallel to and of substantially the same length as the transverse top boards, a bottom leader board parallel to, spaced apart from, and of substantially the same length as the top leader board, and a plurality of support members formed integrally with and perpendicular to the top and bottom leader boards and holding the two leader boards in their spaced-apart configuration, each support member including a protrusion for securing one or more upper support planks, and optionally one or more bearer blocks.

* * * * *